US009839314B2

(12) United States Patent
De La Nuez et al.

(10) Patent No.: US 9,839,314 B2
(45) **Date of Patent: *Dec. 12, 2017**

(54) MAILBOX WITH INSERT

(71) Applicants: Nelson R. De La Nuez, Orlando, FL (US); Wade A. Ragan, Dexter, NM (US); Joshua R. De La Nuez, Melbourne, FL (US)

(72) Inventors: Nelson R. De La Nuez, Orlando, FL (US); Wade A. Ragan, Dexter, NM (US); Joshua R. De La Nuez, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,621

(22) Filed: May 16, 2017

(65) Prior Publication Data

US 2017/0273491 A1 Sep. 28, 2017

Related U.S. Application Data

(63) Continuation of application No. PCT/US2016/040720, filed on Jul. 1, 2016, which is a continuation of application No. 15/078,928, filed on Mar. 23, 2016, now Pat. No. 9,675,195.

(51) Int. Cl.
*A47G 29/12* (2006.01)
*A47G 29/122* (2006.01)

(52) U.S. Cl.
CPC ..... *A47G 29/12097* (2017.08); *A47G 29/122* (2013.01); *A47G 29/1209* (2013.01)

(58) Field of Classification Search
CPC ..... A47G 29/122; A47G 29/1209; A47G 29/12097; A47B 96/025; A47B 45/00; B65D 1/34
USPC ..... 232/17, 45, 29, 33; 211/175, 132.1, 211/126.15; 206/557
See application file for complete search history.

(56) References Cited

U.S. PATENT DOCUMENTS 2,685,372 A * 8/1954 Palaith ..... A47B 96/025 211/135
4,600,143 A * 7/1986 Harlow, Jr. ..... A47G 29/1216 232/17
4,714,192 A * 12/1987 Harlow, Jr. ..... A47G 29/1216 211/126.15
4,753,385 A * 6/1988 Phipps ..... A47G 29/1209 211/132.1
4,863,096 A * 9/1989 Thomas ..... A47G 29/12 232/17

(Continued)

*Primary Examiner* — William Miller
(74) *Attorney, Agent, or Firm* — IDP Patent Services; Olav M. Underdal

(57) ABSTRACT

A mailbox for preventing mail from contacting pooling water in the mailbox includes a mailbox body and a mailbox insert, including: a front section, including a slanted portion, a front support which is connected to the slanted portion, a middle support, and a front lateral adjustment component; and a rear section, including a rear support which is connected to a rear end of the rear section, at least one side hook, and a rear lateral adjustment component; wherein the front section is configured to be insertable into the at least one side hook such that the front section is slidably coupled to the rear section; and wherein the front lateral adjustment component and the rear lateral adjustment component are configured to expand and contract laterally.

20 Claims, 10 Drawing Sheets

(56) References Cited

U.S. PATENT DOCUMENTS

| | | | | | |
|---|---|---|---|---|---|
| 5,009,366 | A * | 4/1991 | van Druff, Jr. | A47G 29/1209 | 232/17 |
| 5,765,749 | A * | 6/1998 | Harper | A47G 29/1209 | 232/17 |
| 5,775,578 | A * | 7/1998 | Baxi | A47G 29/1209 | 232/17 |
| 6,161,756 | A * | 12/2000 | Upton | A47G 29/1216 | 232/39 |
| 6,739,461 | B1 * | 5/2004 | Robinson | A47F 1/12 | 211/175 |
| 7,000,826 | B2 * | 2/2006 | Billings | A47G 29/1209 | 232/17 |
| 7,090,119 | B1 * | 8/2006 | Lackey | A47G 29/1209 | 232/17 |
| 7,210,616 | B1 * | 5/2007 | Van Watermulen | A47G 29/1209 | 232/17 |
| 7,451,912 | B1 * | 11/2008 | Taube, II | A47G 29/1209 | 232/17 |
| 8,042,729 | B2 * | 10/2011 | Dinh | A47G 29/1209 | 232/17 |
| 8,616,435 | B2 * | 12/2013 | Crabtree | A47G 29/1209 | 232/17 |
| 8,789,803 | B2 * | 7/2014 | Van Wingerden | A47G 29/1216 | 232/17 |
| 2003/0136919 | A1 * | 7/2003 | Cunningham | A61L 2/10 | 250/455.11 |
| 2004/0140347 | A1 * | 7/2004 | Mihaylov | A47G 29/1212 | 232/31 |
| 2006/0022028 | A1 * | 2/2006 | Thomas | A47G 29/1209 | 232/29 |

* cited by examiner

Mailbox with Insert

Mailbox Insert

MAILBOX WITH INSERT

CROSS-REFERENCE TO RELATED APPLICATIONS

This United States Non-Provisional Application is a continuation of International PCT Application No. PCT/US16/40720, filed Jul. 1, 2016, which claims the benefit of U.S. Non-Provisional application Ser. No. 15/078,928, filed Mar. 23, 2016.

FIELD OF THE INVENTION

The present invention relates generally to the field of mailboxes and devices for mailboxes. More particularly, the present invention relates to an insert for mailboxes to prevent water from pooling in the interior of the mailbox.

BACKGROUND OF THE INVENTION

Mailboxes are commonly located in the outdoors, where they are subject to a variety of conditions which may degrade their structure over time. Such conditions can include, but are not limited to, corrosion, water or excessive humidity inside the mailbox, accidental damage, and vandalism. Any degradation to a mailbox can result in cracks or holes in the mailbox structure, which can further result in water from storms or sprinklers leaking into the interior of the mailbox.

Mailbox doors are particularly vulnerable to water penetration, since mailbox doors experience wear and tear from regular use. Over time, the locking mechanism of the door tends to degrade, leading to a poor seal around the mailbox body. Mailbox doors also have a tendency to open during strong wind conditions, which can lead to water entering the interior of the mailbox and damaging any mail contained therein.

Most mailboxes are equipped with drain holes on their bottom side to facilitate the draining of any water that may tend to pool up in the interior of the mailbox. However, if mail is situated in the mailbox such that it blocks the drain holes while water is leaking into the mailbox, the water will not have an easy outlet and will thus tend to pool in the interior of the mailbox, potentially ruining the mail. As a result, demand exists for an easily configurable mailbox insert designed to protect mail from pooling water and ensure that leaking water has continuous access to the mailbox drainage holes.

SUMMARY OF THE INVENTION

The foregoing needs are met, to a great extent, by the present invention, wherein in aspects of this invention, enhancements are provided to the existing model of mailbox inserts.

Aspects of the present invention relate to a mailbox with a mailbox insert for keeping mail above the interior surface of the mailbox while allowing water to drain out of the mailbox.

In related aspects, the mailbox insert can be configured to expand and contract along its length and width, thereby ensuring that the mailbox insert will be usable for a wide variety of mailbox dimensions.

In an aspect, a mailbox insert can include:

a) a front section, including:
  i) a front flat portion;
  ii) a slanted portion, which is connected to a front end of the front flat portion, such that the slanted portion slants downward from the front flat portion;

iii) a front support, which is connected to the slanted portion, such that the front support is configured as a rearward protruding hook;
  iv) a middle support, which is connected to the front flat portion, such that the middle support is configured as a forward protruding hook; and
  v) a front lateral adjustment component;

b) a rear section, including:
  i) a rear flat portion;
  ii) a rear support, which is connected to a rear end of the rear flat portion, such that the rear support is configured as a forward protruding hook;
  iii) a rear lateral adjustment component; and
  iv) at least one side hook, which is connected to a side of the rear flat portion, such that the at least one side hook is configured as an inward protruding hook;

wherein the front flat portion is configured to be insertable into the at least one side hook such that the front section is slidably coupled to the rear section, thereby allowing a user to change a length of the mailbox insert; and wherein the front lateral adjustment component and the rear lateral adjustment component are configured to expand and contract laterally, thereby allowing a user to change a width of the mailbox insert.

In related aspects, the mailbox insert can be designed to be inexpensive, lightweight, sturdy, waterproof, convenient, and configurable for a wide variety of mailbox interior dimensions. In related aspects, the mailbox insert can reduce the likelihood of water pooling in the interior of a mailbox and causing water damage to mail in the interior of the mailbox.

In other related aspects, the mailbox insert does not require special tools to assemble or configure.

In other related aspects, once the mailbox insert has been properly assembled and configured by a user, the mailbox insert can remain in the interior of a mailbox without the need for further intervention by the user.

In other related aspects, the mailbox insert can be configured without the front and rear lateral adjustment components, whereby the mailbox insert has a fixed width.

In other related aspects, the mailbox insert can be configured such that the front section and rear section are permanently attached, whereby the mailbox insert has a fixed length.

In other related aspects, the mailbox insert can comprise a mesh structure, wherein the mesh structure comprises a plurality of diamond-shaped apertures that facilitate the draining and evaporation of water in the interior of the mailbox.

In other related aspects, the mailbox insert can be configured such that the mailbox insert is permanently connected to the interior of the mailbox.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
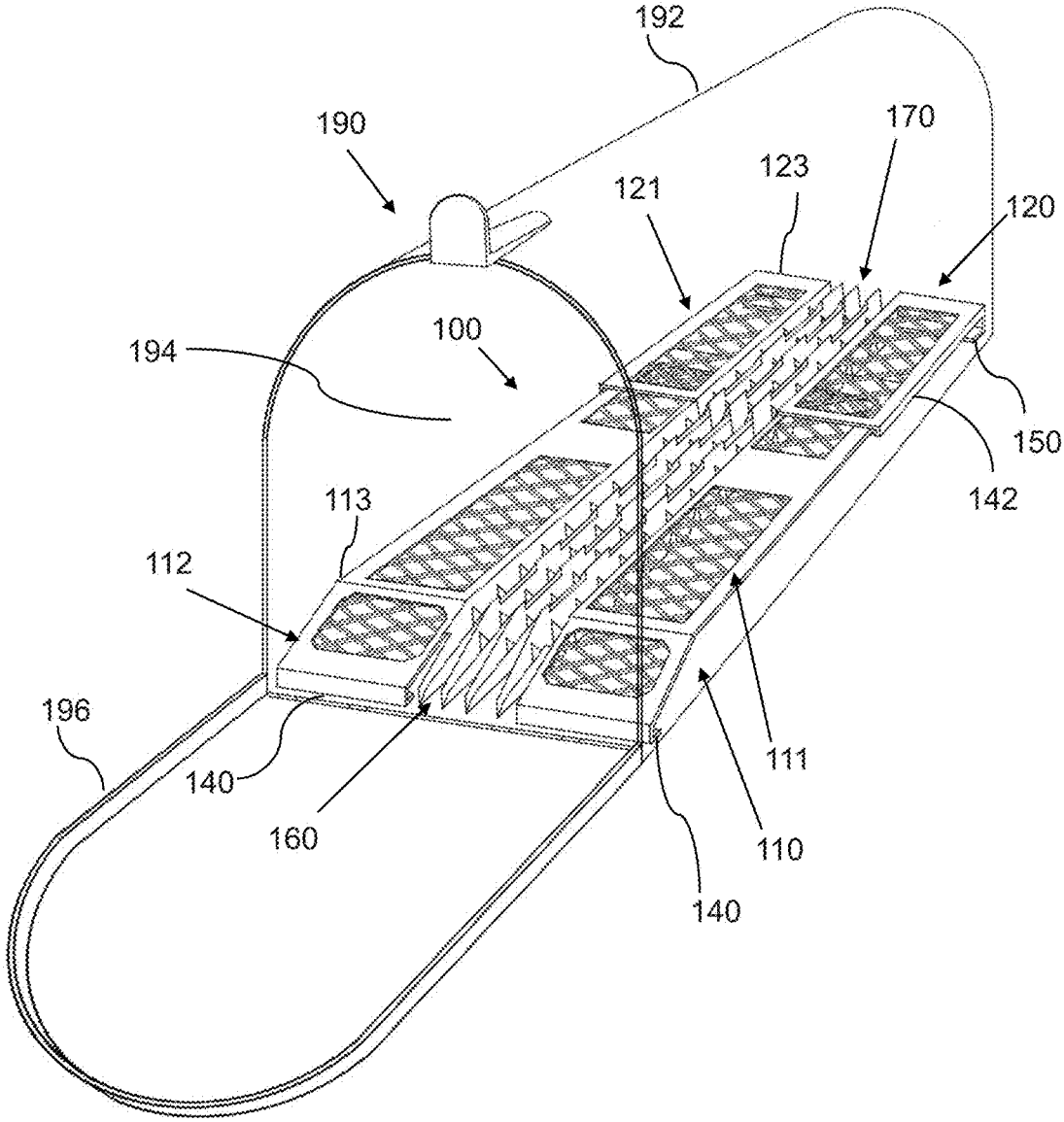
FIG. 1A illustrates a perspective view of a mailbox with a mailbox insert, showing the mailbox as transparent, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a mailbox insert 100 with reference to FIG. 1A, in such manner that like reference numerals refer to like components throughout; a convention that we shall employ for the remainder of this specification.

Figure 1B:
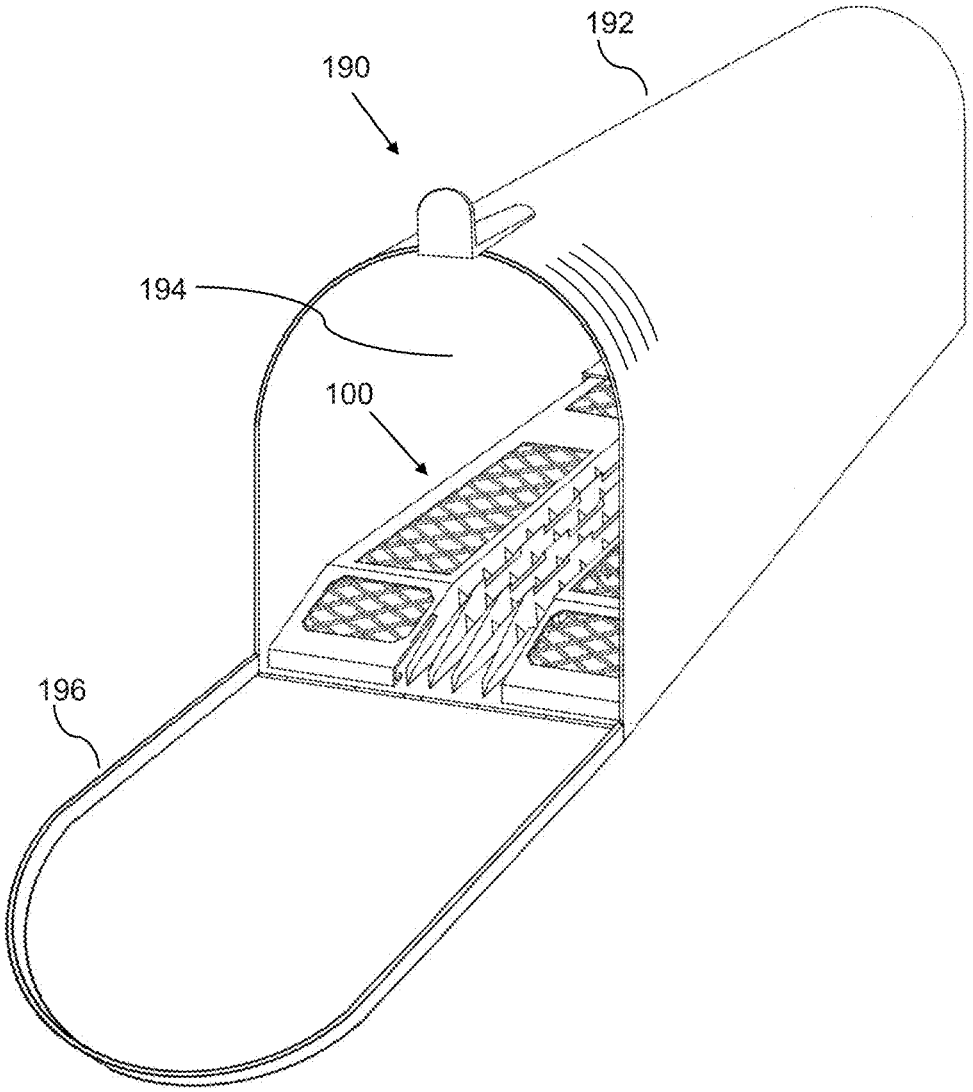
FIG. 1B illustrates a perspective view of a mailbox with a mailbox insert, according to an embodiment of the invention.

In an embodiment, as shown in FIGS. 1A and 1B, a mailbox 190 can include:

a) a mailbox body 192, wherein the mailbox body 192 is configured to define a mailbox interior 194; and b) a mailbox insert 100, which can be positioned inside the mailbox interior 194.

In a related embodiment, the mailbox insert 100 can be permanently attached to the mailbox body 192, inside the mailbox interior 194, for example by use of an adhesive, by welding, or as part of injection molding.

Figure 1C:
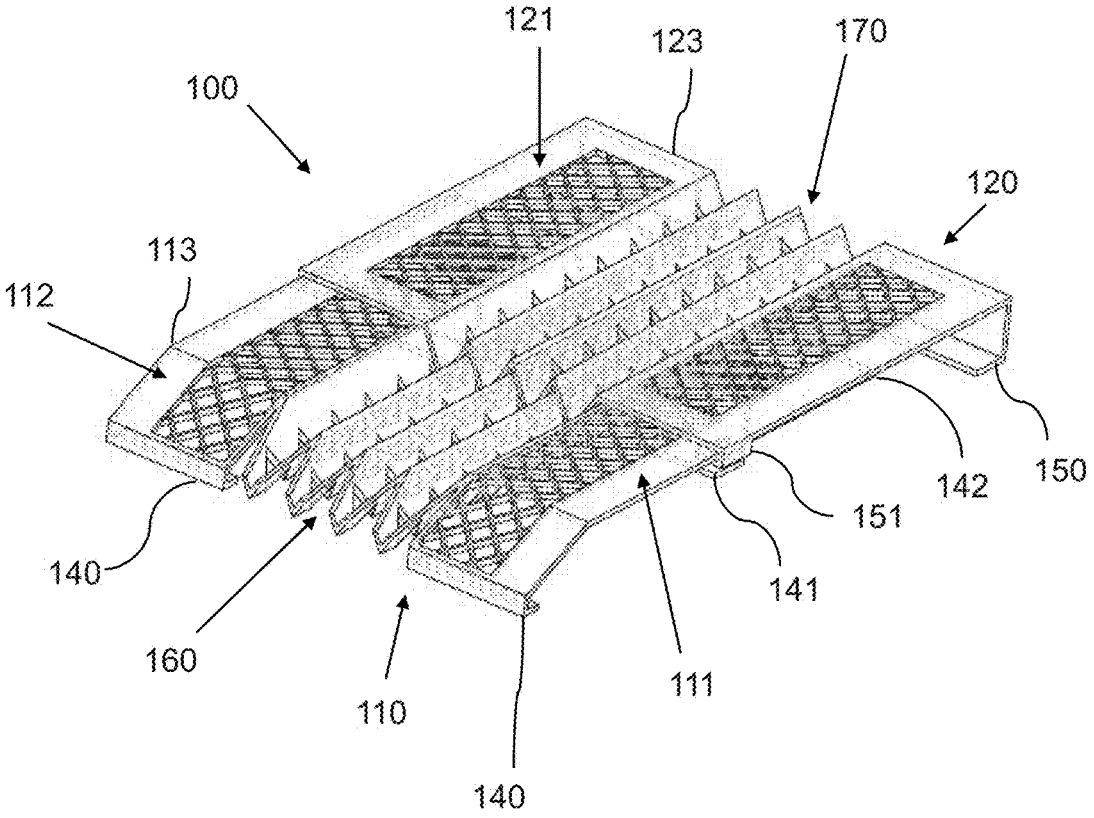
FIG. 1C illustrates a perspective view of a mailbox insert, according to an embodiment of the invention.
Figure 2:
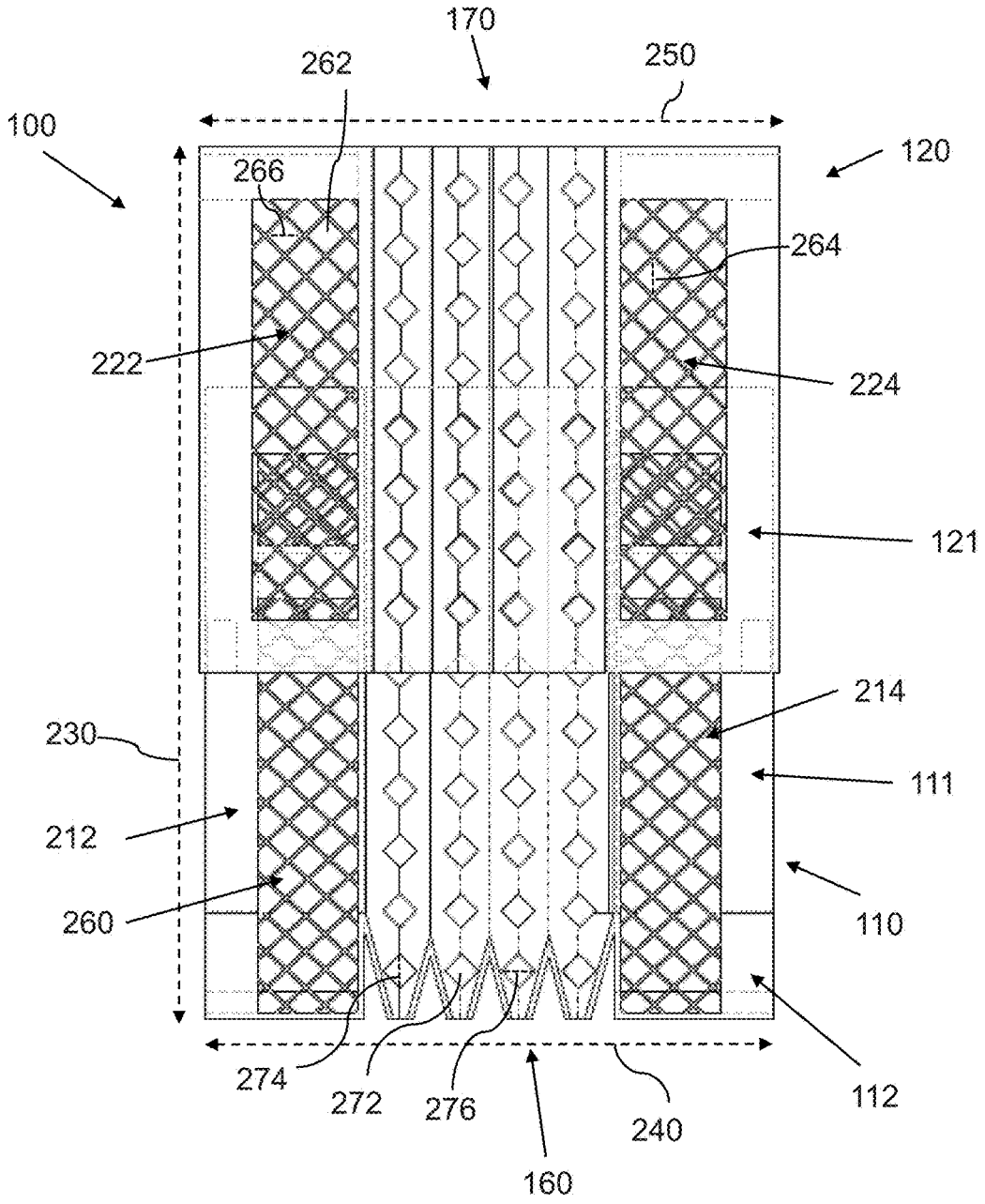
FIG. 2 illustrates a top perspective view of a mailbox insert, according to an embodiment of the invention.

In a related embodiment, as shown in FIGS. 1A and 1C, a mailbox insert 100 can include:

a) a front section 110, including:
   i) a front flat portion 111;
   ii) a slanted portion 112, which is connected to a front end 113 of the front flat portion 111, such that the slanted portion 112 slants downward from the front flat portion 111;
   iii) a front support 140, which is connected to the slanted portion 112, such that the front support 140 is configured as a rearward protruding hook;
   iv) a middle support 141, which is connected to the front flat portion 111, such that the middle support 141 is configured as a forward protruding hook; and
   v) a front lateral adjustment component 160; and b) a rear section 120, including:
   i) a rear flat portion 121;
   ii) a rear support 150, which is connected to a rear end 123 of the rear flat portion 121, such that the rear support 150 is configured as a forward protruding hook;
   iii) a rear lateral adjustment component 170; and
   iv) at least one side hook 151, which is connected to a side of the rear flat portion 121, such that the at least one side hook 151 is configured as an inward protruding hook;

wherein the front, middle, and rear supports 140 141 150 are configured to enable the mailbox insert 100 to rest stably inside the interior of a mailbox body 192, when the mailbox insert 100 is inserted into the mailbox body 192;

wherein the front flat portion 111 is configured to be insertable into the at least one side hook 151 such that the front section 110 is slidably coupled to the rear section 120 along a longitudinal axis of the mailbox insert 100, thereby allowing a user to change a length 230, as shown in FIG. 2, of the mailbox insert 100; and wherein the front lateral adjustment component 160 and the rear lateral adjustment component 170 are configured to expand and contract along a lateral axis of the mailbox insert 100, thereby allowing the user to change a width of the mailbox insert 100.

In a related embodiment, as illustrated in FIGS. 1A and 1B, a mailbox 190 can comprise a mailbox body 192 and a door 196. The mailbox body 192 can define a mailbox interior 194 for receiving mail. In certain embodiments, the mailbox insert 100 can be removably inserted into the mailbox 190. In other embodiments, the mailbox insert 100 can be configured such that it is attached to the mailbox interior 194. The mailbox insert 100 can be attached to the mailbox interior 194 by glue, welds, bolts, or via any other method known to those skilled in the art. The mailbox insert 100 may also be manufactured integrally with the mailbox 190.

In a related embodiment, the front and rear flat portions 111 121 are configured to provide a substantially level flat surface that can support mail. The mailbox insert 100 can be supported on a bottom surface of an interior of the mailbox 190 by the front support 140, middle support 141 and rear support 150.

In a related embodiment, FIG. 2 shows a top view of the mailbox insert 100.

In a related embodiment, as illustrated in FIG. 2, the mailbox insert 100 can have a length 230 measured along a longitudinal axis of the mailbox insert 100. The front section 110 can be slidably coupled with the rear section 120, so as to allow the mailbox insert 100 to longitudinally expand or contract, thereby altering the length 230 of the mailbox insert 100 to fit the dimensions of a mailbox 190.

In a further related embodiment, as illustrated in FIG. 2, the front section 110 can have a width 240 measured along a lateral axis of the mailbox insert 100.

In a related embodiment, as illustrated in FIG. 2, the front section 110 can comprise a left front section 212 and a right front section 214.

In a related embodiment, the front lateral adjustment component 160 can be connected to the left front section 212 and the right front section 214 such that the front lateral adjustment component 160 can allow the front section 110 to laterally expand or contract, thereby altering the width 240 of the front section 110 to fit the dimensions of a mailbox 190.

In a related embodiment, as illustrated in FIG. 2, the rear section 120 can have a width 250 measured along a lateral axis of the mailbox insert 100.

In a related embodiment, as illustrated in FIG. 2, the rear section 120 can comprise a left rear section 222 and a right rear section 224.

In a related embodiment, the rear lateral adjustment component 170 can be connected to the left rear section 222 and the right rear section 224 such that the rear lateral adjustment component 170 can allow the rear section 120 to laterally expand or contract, thereby altering the width 250 of the rear section 120 to fit the dimensions of a mailbox 190.

In a related embodiment, as illustrated in FIG. 2, the mailbox insert 100 can be configured such that both the left and right front sections 212 214 and the left and right rear sections 222 224 can include a drainage surface 260. Each drainage surface 260 can be configured as a mesh structure, which includes a plurality of drainage apertures 262. The drainage apertures 262 can be diamond-shaped, as shown in FIG. 2, and can also be referred to as rhombus-shaped.

In a related embodiment, the drainage surfaces 260 allow water to drain through the diamond-shaped apertures 262 and thereby drain to the bottom of the interior of the mailbox 190, leaving mail that is placed on the mailbox insert 100 positioned safely above the drained water.

In a related embodiment, the diamond-shaped apertures 262 can be configured such that longitudinal and lateral diagonals 264 266 of the diamond-shaped apertures 262 are parallel to respectively the longitudinal and lateral directions 230 250 of the mailbox insert 100, whereby the friction resulting from the slidably coupled configuration of the front section 110 and rear section 120 can be substantially decreased, and letters will be less likely to become stuck on the surface of the mailbox insert 100, when the letters are inserted or retrieved from the mailbox 190.

In a related embodiment, as illustrated in FIG. 2, the front and rear lateral adjustment components 160 170 can be configured to include a plurality of drainage cutouts 272. The drainage cutouts 272 can be diamond-shaped, as shown in FIG. 2, and can also be referred to as rhombus-shaped. The drainage cutouts 272 can be configured as triangular cutouts from the bottom of the front and rear lateral adjustment components 160 170, as will be more fully described hereinafter. The drainage cutouts 272 allow water to drain through the drainage cutouts 272 and thereby drain to the bottom of the interior of the mailbox 190.

In a related embodiment, the drainage cutouts 272 can be configured such that longitudinal and lateral diagonals 274 276 of the drainage cutouts 272 are parallel to respectively the longitudinal and lateral directions 230 250 of the mailbox insert 100. Furthermore, the lateral diagonal 276 of the drainage cutouts 272 can be configured to increase and decrease in length as the front and rear lateral adjustment components 160 170 expand and contract, respectively.

Figure 3:
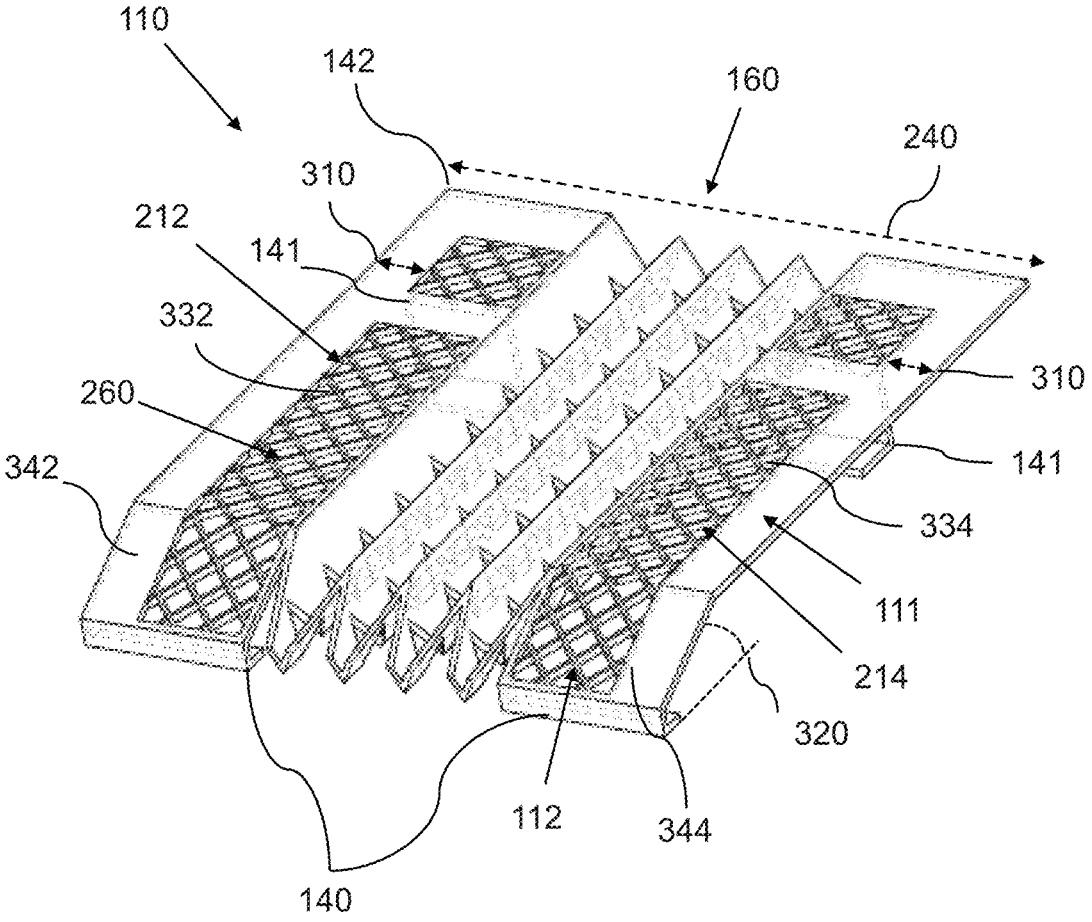
FIG. 3 illustrates a perspective view of a mailbox insert, according to an embodiment of the invention.

In a related embodiment, FIG. 3 shows a perspective view of the front section 110 of the mailbox insert 100.

In a further related embodiment, the front section 110 further comprises a rear end 142. The rear end 142 can be slidably received by the at least one side hook 151, as shown in FIG. 1C, thereby slidably coupling the front section 110 and the rear section 120.

In a further related embodiment, the slanted portion 112 can slant downward from the front flat portion 111 at an angle 320 from the front flat portion 111. Generally, the angle 320 can be between 5° and 85°, but in certain embodiments the angle 320 can be 90° or greater.

In a related embodiment, as illustrated in FIG. 3, the front flat portion 111 can comprise a left front flat portion 332 and a right front flat portion 334. Furthermore, the slanted portion 112 can comprise a left slanted portion 342 and a right slanted portion 344. The left slanted portion 342 can slant downward from the left front flat portion 332, and the right slanted portion 344 can slant downward from the right front flat portion 334.

In a further related embodiment, the left front section 212 can comprise the left front flat portion 332 and the left slanted portion 342. In a yet further related embodiment, the right front section 214 can comprise the right front flat portion 334 and the right slanted portion 344.

In a further related embodiment, as illustrated in FIG. 3, the front section 110 can be configured such that the front lateral adjustment component 160 is connected to the left front flat portion 332 and the right front flat portion 334 such that the front lateral adjustment component 160 is between the left front flat portion 332 and the right front flat portion 334.

In another further related embodiment, as illustrated in FIG. 3, the front support 140 can be configured as two front supports 140, which can provide space for the front lateral adjustment component 160.

In a further related embodiment, as illustrated in FIG. 3, the middle support 141 can be configured as two middle supports 141, which can provide space for the front lateral adjustment component 160. The middle supports 141 can be connected to the front flat portion 111 at a distance 310 away from the sides of the front flat portion 111 such that the middle supports 141 do not interfere with the at least one side hook 151 when the front section 110 and the rear section 120 are slidably coupled, as shown in FIGS. 1C and 2.

In a related embodiment, as illustrated in FIG. 3, the middle supports 141 can be configured as forward protruding hooks. However, in other embodiments the middle supports 141 can be configured as rearward protruding hooks or straight legs. Similarly, the front supports 140 are depicted in FIG. 3 as rearward protruding hooks. However, in other embodiments the front supports can be configured as forward protruding hooks or straight legs.

In a related embodiment, the front section 110 can be fully supported by the front supports 140 and middle supports 141, whereby in certain embodiments the front section 110 can be placed in a mailbox 190 as a standalone mailbox insert without the rear section 120.

Figure 4:
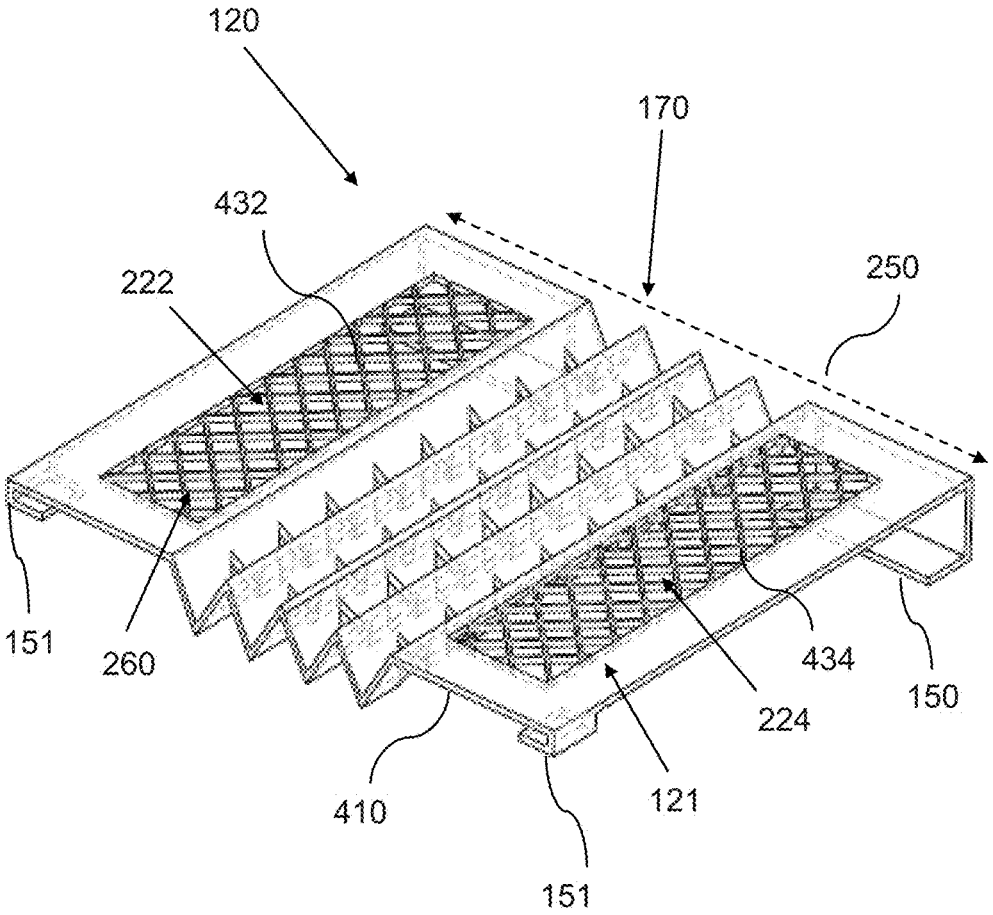
FIG. 4 illustrates a perspective view of a mailbox insert, according to an embodiment of the invention.

In a related embodiment, FIG. 4 shows a perspective view of the rear section 120 of the mailbox insert 100.

In a related embodiment, as illustrated in FIG. 4, the rear flat portion 121 can comprise a left rear flat portion 432 and a right rear flat portion 434.

In a related embodiment, the left rear section 222 can comprise the left rear flat portion 432, and the right rear section 224 can comprise the right rear flat portion 434.

In a further related embodiment, as illustrated in FIG. 4, the rear section 120 can be configured such that the rear lateral adjustment component 170 is connected to the left rear flat portion 432 and the right rear flat portion 434 such that the rear lateral adjustment component 170 is between the left front flat portion 432 and the right front flat portion 434.

In a related embodiment, as illustrated in FIG. 4, the rear support 150 can be configured as two rear supports 150, which can provide space for the rear lateral adjustment component 170.

In a related embodiment, as illustrated in FIG. 4, the rear supports 150 can be configured as forward protruding hooks. However, in other embodiments the rear supports 150 can be configured as rearward protruding hooks or straight legs.

In a related embodiment, as illustrated, in FIG. 4, the at least one side hook 151 can be configured as two or more side hooks 151. Furthermore, as depicted in FIG. 4, the side hooks 151 can be configured to extend below the rear flat portion 121. However, in other embodiments, the side hooks 151 can extend above the rear flat portion 121.

In a related embodiment, the at least one side hook 151 can be connected to the front section 110 such that the rear section 120 is slidably coupled to the front section 110 along the longitudinal axis of the mailbox insert 100, thereby allowing a user to change a length 230 of the mailbox insert 100.

Figure 5:
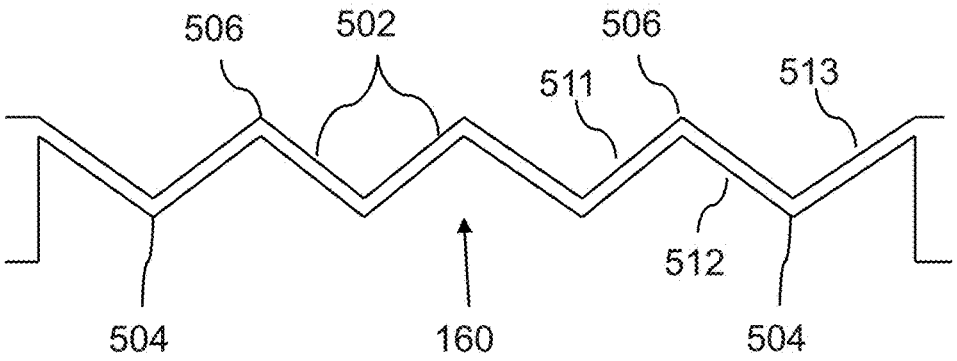
FIG. 5 is a schematic diagram of a lateral adjustment component of a mailbox insert, according to an embodiment of the invention.
Figure 6:
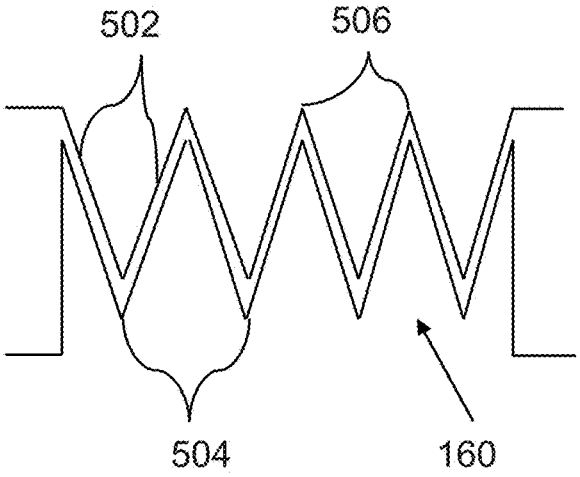
FIG. 6 is a schematic diagram of a lateral adjustment component of a mailbox insert, according to an embodiment of the invention.

In a related embodiment, FIGS. 5 and 6 depict schematic diagrams of the front lateral adjustment component 160.

In a related embodiment, as illustrated in FIG. 5, the front lateral adjustment component 160 can be expanded laterally into an extended state. Similarly, as shown in FIG. 6, the front lateral adjustment component 160 can be contracted laterally into a compacted state. The lateral adjustment component 160 can be configured as a pleated structure comprising a plurality of panels 502 pivotally coupled by a plurality of lower hinge mechanisms 504 and upper hinge mechanisms 506, such that:

a) a first panel 511 is pivotally coupled to a second panel 512 by an upper hinge mechanism 506; and b) a third panel 513 is pivotally coupled to the second panel 512 by a lower hinge mechanism 504.

The hinge mechanisms 504 506 can be configured as plastic living hinges, i.e. thin flexible hinges made from the same material as the panels 502 that they connect, such the living hinges 504 506 can be manufactured by injection molding, as is well-known in the art. However, the hinge mechanisms 504 506 may also be manufactured using any other suitable process. The hinge mechanisms 504 506 allow the pivotally-coupled panels 502 to expand and contract the front lateral adjustment component 160 such that the front section 110 can be configured to have a range of widths 240, not limited by the configurations depicted in FIGS. 5 and 6.

In a related embodiment, the rear lateral adjustment component 170 can be configured to function similarly to the front lateral adjustment component 160, as depicted in FIGS. 5 and 6, such that the rear section 120 can be configured to have a range of widths 250. As shown in FIG. 2, the rear lateral adjustment component 170 can be configured to function in conjunction with the front lateral adjustment component 160 such that the width 240 of the front section 110 and the width 250 of the rear section 120 are substantially similar.

Figure 7:
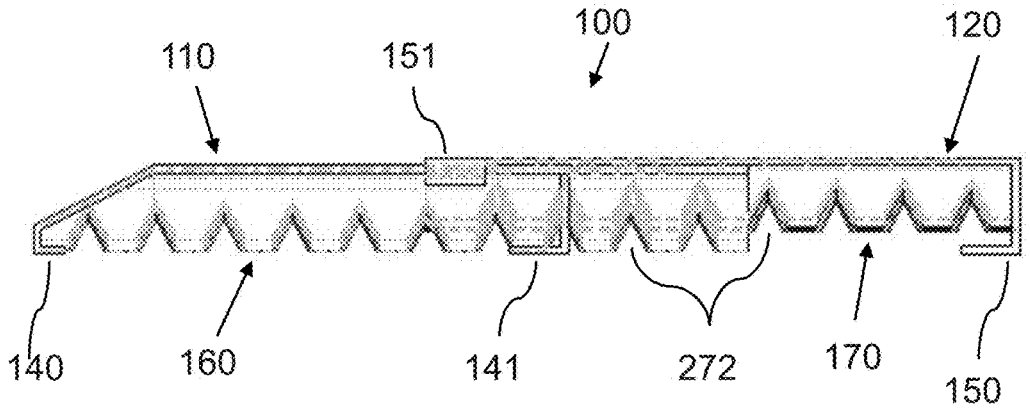
FIG. 7 illustrates a side view of a mailbox insert, according to an embodiment of the invention.

In a related embodiment, FIG. 7 shows a side view of the mailbox insert 100.

In a related embodiment, as illustrated in FIG. 7, the mailbox insert 100 can be supported on an interior surface of a mailbox 190 by the front support 140, middle support 141, and rear support 150, wherein the front, middle, and rear supports 140 141 151 can be configured to be substantially level.

In a related embodiment, as illustrated in FIGS. 2 and 7, the drainage cutouts 272 can be configured as triangular cutouts along the lower hinge mechanisms 504 of the panels 502 of both the front and rear lateral adjustment components 160 170. Each triangular cutout forms half of the diamond shape of the drainage cutouts 272, as shown in FIG. 2.

Figure 8:
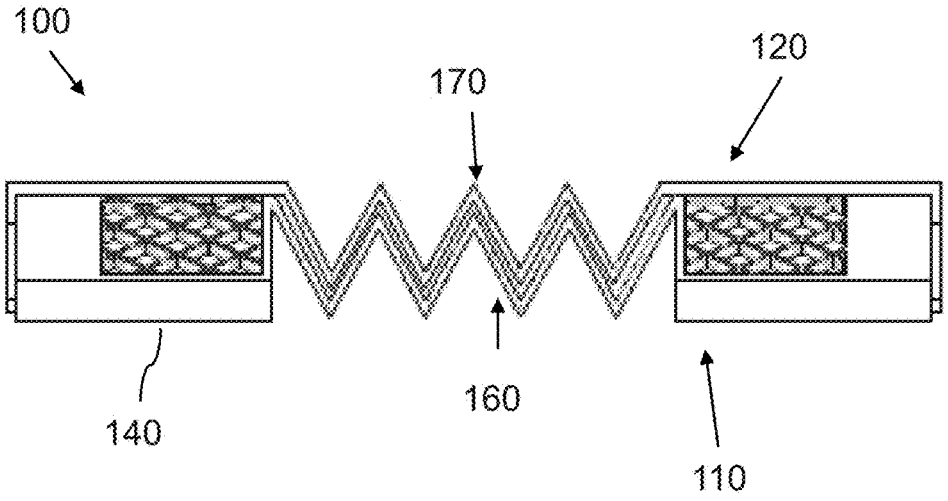
FIG. 8 illustrates a front view of a mailbox insert, according to an embodiment of the invention.

In a related embodiment, FIG. 8 shows a front view of the mailbox insert 100.

In a related embodiment, as illustrated in FIG. 8, the front and rear sections 110 120 can be configured such that the rear lateral adjustment component 170 is adjacent to the front lateral adjustment component 160 when the front and rear sections 110 120 are slidably coupled, so as to allow the rear lateral adjustment component 170 to expand or contract simultaneously with the front lateral adjustment component 160. In certain embodiments, such as shown in FIG. 8, the rear lateral adjustment component 170 can be above the front lateral adjustment component 160. However, in other embodiments the rear lateral adjustment component 170 can be below the front lateral adjustment component 160.

In related embodiments, the mailbox insert 100 can be manufactured in plastic and/or metal materials.

Figure 9:
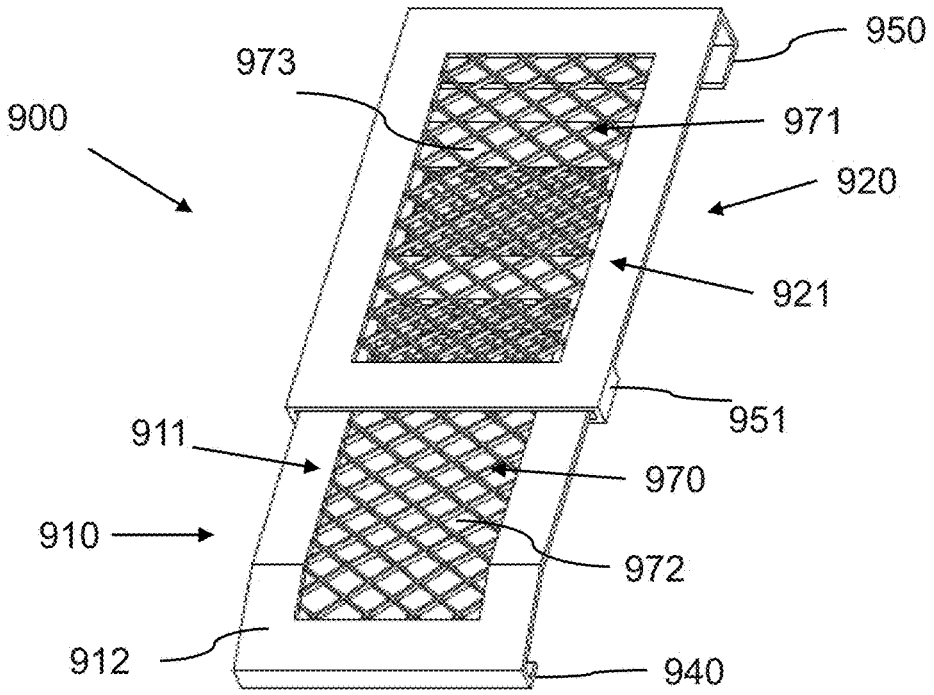
FIG. 9 illustrates a perspective view of a mailbox insert, according to an embodiment of the invention.
Figure 10:
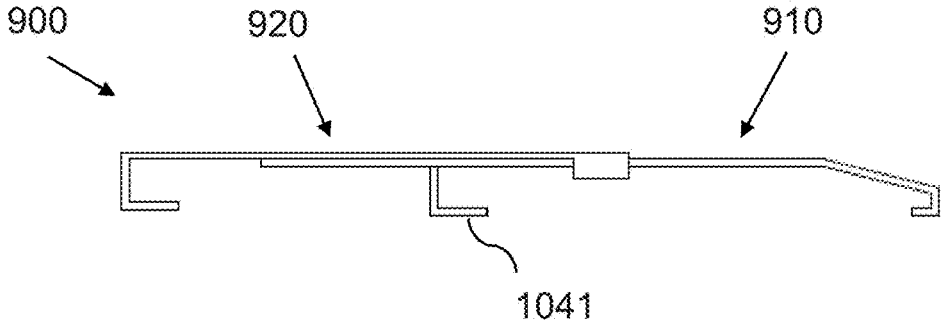
FIG. 10 illustrates a side view of a mailbox insert, according to an embodiment of the invention.

In a related embodiment, as illustrated in FIG. 9, a mailbox insert 900 can include:

a) a front section 910, including:
   - i) a front flat portion 911;
   - ii) a slanted portion 912, which is connected to a front end of the front flat portion 911, such that the slanted portion 912 slants downward from the front flat portion 911;
   - iii) a front support 940, which is connected to the slanted portion 912, such that the front support 940 is configured as a rearward protruding hook;
   - iv) a middle support 1041, as shown in FIG. 10, which is connected to the front flat portion 911, such that the middle support 1041 is configured as a forward protruding hook;

b) a rear section 920, including:
   - i) a rear flat portion 921;
   - ii) a rear support 950, which is connected to a rear end of the rear flat portion 921, such that the rear support 950 is configured as a forward protruding hook;
   - iii) at least one side hook 951, which is connected to a side of the rear flat portion 921, such that the at least one side hook 951 is configured as an inward protruding hook;

wherein the front flat portion 911 is configured to be insertable into the at least one side hook 951 such that the front section 910 is slidably coupled to the rear section 920 along a longitudinal axis of the mailbox insert 900, thereby allowing a user to change a length of the mailbox insert 900 to fit the dimensions of a mailbox.

In a related embodiment, as shown in FIG. 9, the front section 910 can include a front drainage surface 970. The front drainage surface 970 can be configured as a mesh structure, comprising diamond-shaped apertures 972. Similarly, the rear section 920 can include a rear drainage surface 971. The rear drainage surface 971 can be configured as a mesh structure, comprising diamond-shaped apertures 973. The front and rear drainage surfaces 970, 971 allow water to drain through the diamond-shaped apertures 972, 973 and thereby drain to the bottom of the interior of a mailbox, leaving mail that is placed on the mailbox insert 900 positioned safely above the drained water.

In a related embodiment, the at least one side hook 951 can be connected to the front section 910 such that the rear section 920 is slidably coupled to the front section 910 along the longitudinal axis of the mailbox insert 900, thereby allowing a user to change a length of the mailbox insert 900.

In a related embodiment, FIG. 10 shows a side view of the mailbox insert 900.

In a related embodiment, FIG. 10 depicts the middle support 1041, which can be connected to the front flat portion 911. Furthermore, FIG. 10 depicts the middle support 1041 as a forward protruding hook, although in other embodiments the middle support 1041 can be configured as a rearward protruding hook.

Figure 11:
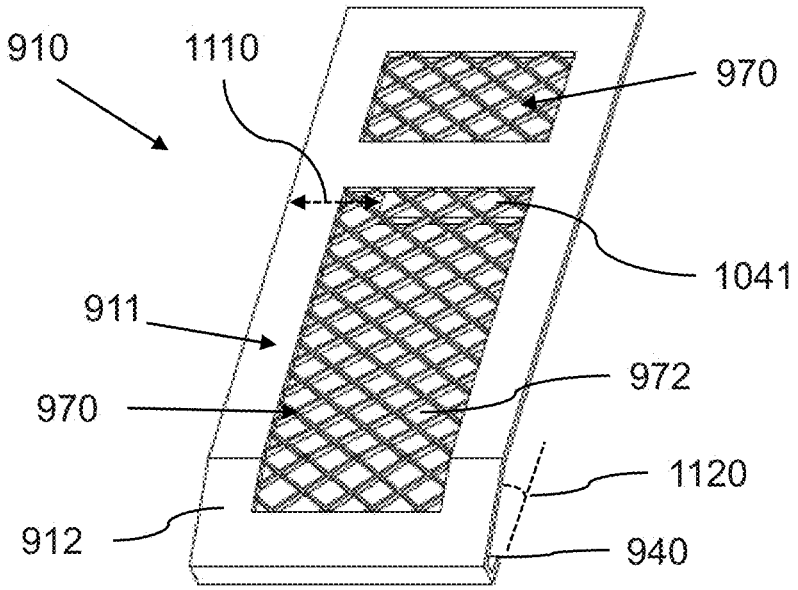
FIG. 11 illustrates a perspective view of a mailbox insert, according to an embodiment of the invention.

In a related embodiment, FIG. 11 shows a perspective view of a front section 910 of the mailbox insert 900.

In a related embodiment, the middle support 1041 can be connected to the front flat portion 911 at a distance 1110 away from a side of the front flat portion 911 such that the middle support 1041 does not interfere with the at least one side hook 951 when the front section 910 and the rear section 920 are slidably coupled, as shown in FIGS. 9 and 10.

In a related embodiment, as illustrated in FIG. 11, the slanted portion 912 slants downward from the front flat portion 911 at an angle 1120 from the front flat portion 911. Generally, the angle 1120 can be between 5° and 85°, but in certain embodiments the angle 1120 can be 90° or greater.

Figure 12:
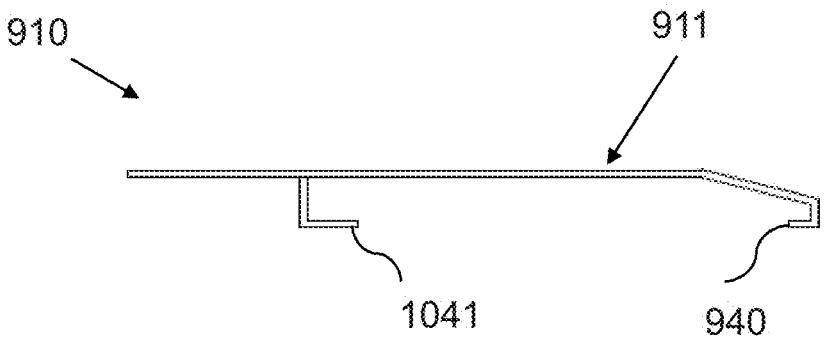
FIG. 12 illustrates a side view of a mailbox insert, according to an embodiment of the invention.

In a related embodiment, FIG. 12 shows a side view of the front section 910 of the mailbox insert 900.

In a related embodiment, as illustrated in FIG. 12, the front section 910, which can also be known as a mailbox insert 910, is fully supported by the front support 940, which can also be known as a first support 940, and the middle support 1041, which can also be known as a second support 1041, whereby in certain embodiments the front section 910 can be placed in a mailbox 190 as a standalone mailbox insert 910 without the rear section 920.

In a related embodiment, the slanted portion 912 can also be known as a ramp portion 912. Furthermore, the front flat portion 911 can also be known as a flat body 911.

In a related embodiment, a mailbox insert 910 can include:

a) a flat body 911;

b) an ramp portion 912, which is connected to a front end of the flat body 911, such that the ramp portion 912 slants downward from the flat body 911;

c) a first support 940, which is connected to the ramp portion 912; and d) a second support 1041, which is connected to the flat body 911.

In a related embodiment, a mailbox 190 can include:

a) a mailbox body 192, wherein the mailbox body 192 is configured to define a mailbox interior 194; and b) a mailbox insert 910, comprising:

i) a flat body 911;

ii) an ramp portion 912, which is connected to a front end of the flat body 911, such that the ramp portion 912 slants downward from the flat body 911;

iii) a first support 940, which is connected to the ramp portion 912; and iv) a second support 1041, which is connected to the flat body 911;

wherein the mailbox insert 910 can be configured such that the mailbox insert 910 is attached to the mailbox interior 194.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A mailbox, comprising:

a mailbox body, wherein the mailbox body is configured to define a mailbox interior; and a mailbox insert, which is positioned inside the mailbox interior, the mailbox insert comprising:

a) a front section, comprising:

a front flat portion;

a slanted portion, which is connected to a front end of the front flat portion, such that the slanted portion slants downward from the front flat portion;

b) a rear section, comprising:

a rear flat portion;

c) a front lateral adjustment component connected to the front section; and d) a rear lateral adjustment component connected to the rear section;

wherein the front section is slidably coupled to the rear section, whereby the mailbox insert is configured to allow a user to change a length of the mailbox insert; wherein the front lateral adjustment component and the rear lateral adjustment component are expandable and contractible along a lateral axis of the mailbox insert, whereby the mailbox insert is configured to allow the user to change a width of the mailbox insert.

2. The mailbox of claim 1, wherein the rear section further comprises:

at least one side hook, which is connected to a side of the rear flat portion, such that the at least one side hook is configured as an inward protruding hook;

wherein the front section is insertable into the at least one side hook, whereby the front section is slidably coupled to the rear section.

3. The mailbox of claim 1, wherein a) the front section further comprises:

a left front section; and a right front section;

wherein the front lateral adjustment component is connected to the left and right front sections, such that the front lateral adjustment component is between the left and right front sections; and b) the rear section further comprises:

a left rear section; and a right rear section;

wherein the rear lateral adjustment component is connected to the left and right rear sections, such that the rear lateral adjustment component is between the left and right rear sections.

4. The mailbox of claim 1, wherein the front and rear lateral adjustment components each comprise:

a) a plurality of panels; and b) a plurality of upper and lower hinge mechanisms;

wherein the panels are pivotally coupled via the upper and lower hinge mechanisms, such that that the panels form a pleated structure;

wherein a first panel is pivotally coupled to a second panel by an upper hinge mechanism; and a third panel is pivotally coupled to the second panel by a lower hinge mechanism.

5. The mailbox of claim 4, wherein the upper and lower hinge mechanisms are configured as plastic living hinges.

6. The mailbox of claim 4, wherein the mailbox insert further comprises a plurality of drainage apertures, wherein the plurality of drainage apertures are configured to allow water to drain through the front and rear sections.

7. The mailbox of claim 6, wherein a) the front section further comprises:

a left front section; and a right front section;

wherein the front lateral adjustment component is connected to the left and right front sections, such that the front lateral adjustment component is between the left and right front sections; and b) the rear section further comprises:

a left rear section; and a right rear section;

wherein the rear lateral adjustment component is connected to the left and right rear sections, such that the rear lateral adjustment component is between the left and right rear sections;

wherein the plurality of drainage apertures comprise a first plurality of drainage apertures and a second plurality of drainage apertures, wherein the left and right front sections and the left and right rear sections further comprise the first plurality of drainage apertures, wherein the front and rear lateral adjustment components further comprise the second plurality of drainage apertures.

8. The mailbox of claim 6, wherein the plurality of drainage apertures are configured as diamond-shaped apertures.

9. The mailbox of claim 8, wherein the plurality of drainage apertures are configured such that longitudinal and lateral diagonals of the drainage apertures are parallel to respectively the longitudinal and lateral axes of the mailbox insert.

10. The mailbox of claim 1, wherein the mailbox insert further comprises:

a) a front support, which is connected to the slanted portion;

b) a middle support, which is connected to the front flat portion; and c) a rear support, which is connected to a rear end of the rear flat portion;

such that the front, middle, and rear supports are configured to enable the mailbox insert to rest stably inside the interior of the mailbox body, when the mailbox insert is inserted into the mailbox body.

11. The mailbox of claim 10, wherein the front support is configured as two front supports, wherein the middle support is configured as two middle supports, and wherein the rear support is configured as two rear supports.

12. The mailbox of claim 10, wherein the front support is configured as a rearward protruding hook, the middle support is configured as a forward protruding hook, and the rear support is configured as a forward protruding hook.

13. The mailbox of claim 1, wherein the mailbox insert is permanently attached to the mailbox body.

14. A mailbox, comprising:

a mailbox body, wherein the mailbox body is configured to define a mailbox interior; and a mailbox insert, which is positioned inside the mailbox interior, the mailbox insert comprising:

a) a flat body, further comprising:

a drainage surface, comprising a plurality of drainage apertures, such that the drainage surface is configured to allow water to drain through the mailbox insert;

b) a ramp portion, which is connected to a front end of the flat body, such that the ramp portion slants downward from the flat body; and c) a lateral adjustment component, comprising a plurality of panels; and a plurality of upper and lower hinge mechanisms;

wherein the lateral adjustment component is expandable and contractible along a lateral axis of the mailbox insert, whereby the mailbox insert is configured to allow a user to change a width of the mailbox insert;

wherein the panels are pivotally coupled via the upper and lower hinge mechanisms, such that that the panels form a pleated structure;

wherein a first panel is pivotally coupled to a second panel by an upper hinge mechanism, and a third panel is pivotally coupled to the second panel by a lower hinge mechanism;

wherein the flat body further comprises a left flat body and a right flat body, wherein the lateral adjustment component is connected to the left and right flat bodies such that the lateral adjustment component is between the left and right flat bodies.

15. The mailbox of claim 14, wherein the plurality of drainage apertures are diamond-shaped apertures.

16. The mailbox of claim 14, wherein the flat body is a first flat body, wherein the mailbox insert further comprises a second flat body, wherein the first flat body is slidably coupled to the second flat body, whereby the mailbox insert is configured to allow a user to change a length of the mailbox insert.

17. The mailbox of claim 16, wherein at least one of the first flat body and the second flat body further comprises at least one side hook, which is connected to a side of the at least one of the first flat body and the second flat body, such that the at least one side hook is configured as an inward protruding hook.

18. The mailbox of claim 16, wherein the mailbox insert further comprises:

a) a first support, which is connected to the ramp portion;

b) a second support, which is connected to the first flat body; and c) a third support, which is connected to the second flat body;

such that the front, middle, and rear supports are configured to enable the mailbox insert to rest stably inside the interior of the mailbox body, when the mailbox insert is inserted into the mailbox body.

19. The mailbox of claim 18, wherein the first support is configured as a rearward protruding hook, the second support is configured as a forward protruding hook, and the third support is configured as a forward protruding hook.

20. The mailbox of claim 14, wherein the mailbox insert is permanently attached to the mailbox body.

* * * * *